US012637250B2

(12) United States Patent
Nowak

(10) Patent No.: US 12,637,250 B2
(45) Date of Patent: May 26, 2026

(54) TRAY WITH DIVIDER FEATURES

(71) Applicant: Graphic Packaging International, LLC, Atlanta, GA (US)

(72) Inventor: Lee Nowak, Leicestershire (GB)

(73) Assignee: Graphic Packaging International, LLC, Atlanta, GA (US)

( * ) Notice: Subject to any disclaimer, the term of this patent is extended or adjusted under 35 U.S.C. 154(b) by 214 days.

(21) Appl. No.: 18/196,514

(22) Filed: May 12, 2023

(65) Prior Publication Data

US 2023/0365293 A1 Nov. 16, 2023

Related U.S. Application Data

(60) Provisional application No. 63/341,716, filed on May 13, 2022.

(51) Int. Cl.

| | |
|---|---|
| ***B65D 5/4805*** | (2006.01) |
| ***B65D 5/30*** | (2006.01) |
| ***B65D 5/48*** | (2006.01) |

(52) U.S. Cl.

CPC ..... *B65D 5/4801* (2013.01); *B65D 5/305* (2013.01)

(58) Field of Classification Search

CPC ..... B65D 5/48016; B65D 5/48008; B65D 5/48002; B65D 5/48004; B65D 5/48006; B65D 5/4801; B65D 5/48014; B65D 5/48018; B65D 5/4802

USPC ..... 229/120.13, 120.08, 120.11, 120.12, 229/120.14, 120.15, 120.18, 120, 12

See application file for complete search history.

(56) References Cited

U.S. PATENT DOCUMENTS

| | | | |
|---|---|---|---|
| 662,969 | A | 12/1900 | Roth |
| 978,569 | A | 12/1910 | Elkin |
| 1,048,577 | A | 12/1912 | Pardoe |
| 1,516,090 | A | 11/1924 | Gary et al. |
| 1,651,848 | A | 12/1927 | Stevens |
| 1,667,376 | A | 4/1928 | Fehrenkamp |
| 1,814,561 | A | 7/1931 | Krumm |
| 1,824,862 | A | 9/1931 | Young |

(Continued)

FOREIGN PATENT DOCUMENTS

| | | |
|---|---|---|
| CA | 2 586 472 | 5/2006 |
| DE | 75 23 198 | 11/1975 |

(Continued)

OTHER PUBLICATIONS

Translation of FR-2502120 (Date Sep. 24, 1982).*

(Continued)

*Primary Examiner* — Nathan J Newhouse
*Assistant Examiner* — Nina K Attel
(74) *Attorney, Agent, or Firm* — Andrew N. Claerbout; FisherBroyles, LLP

(57) ABSTRACT

A tray for holding one or more articles includes a plurality of panels extending at least partially around an interior space of the tray, the plurality of panels including a bottom panel, a front panel, a back panel, and at least one side panel, a plurality of end flaps foldably connected to a respective panel of the plurality of panels, and divider features at least partially foldably connected to a respective panel of the plurality of panels, the divider features extend into the interior space of the tray to at least partially form a plurality of compartments in the interior space of the tray.

20 Claims, 6 Drawing Sheets

(56) References Cited

U.S. PATENT DOCUMENTS 2,054,596 A 9/1936 Ford
2,091,126 A 8/1937 Speer
2,100,888 A 11/1937 Vine
2,107,946 A 2/1938 Inman
2,132,966 A 10/1938 O'Brien
2,180,808 A 11/1939 Jacobstein et al.
2,194,220 A 3/1940 Elder
2,312,595 A 3/1943 Smith
2,337,654 A 12/1943 Goodyear
2,345,000 A 3/1944 Newsom
2,363,861 A 11/1944 Goodyear
2,565,146 A 8/1951 Okon
2,569,733 A * 10/1951 Ringler ..... B65D 5/5021 229/120.13
2,583,915 A 1/1952 Whitley
2,710,133 A * 6/1955 Repking ..... B65D 5/4295 229/120.13
2,769,971 A 11/1956 Bashe
2,804,252 A 8/1957 Nute
2,833,458 A 5/1958 Toensmeier
2,844,294 A 7/1958 Williams
2,852,177 A 9/1958 Frasch
2,862,612 A 12/1958 Brown
2,877,736 A 3/1959 Simmons
2,894,672 A * 7/1959 Bamburg ..... B65D 5/0035 229/172
2,924,371 A 2/1960 Frankenstein
2,924,372 A 2/1960 Kirkeby
2,955,733 A 10/1960 Wilson
2,967,610 A 1/1961 Ebert
3,003,584 A 10/1961 Coe
3,071,882 A 1/1963 Eisman et al.
3,099,381 A 7/1963 Meyers
3,107,039 A 10/1963 Painter
3,142,430 A 7/1964 Meyers
3,146,933 A 9/1964 Moore
3,181,770 A 5/1965 Coe
3,189,247 A 6/1965 Wischusen
3,204,814 A 9/1965 Mahon
3,205,603 A 9/1965 Brumley
3,240,419 A 3/1966 Spiering et al.
3,297,228 A * 1/1967 Contratto ..... B65D 5/48018 229/149
3,324,998 A 6/1967 Farquhar
3,366,303 A 1/1968 Kaspar
3,499,595 A 3/1970 Brooks
3,515,331 A 6/1970 Guthrie
3,637,130 A 1/1972 Farquhar
3,692,228 A 9/1972 Spiege
3,721,380 A 3/1973 Meyers
3,809,310 A 5/1974 VanderLugt, Jr.
3,876,131 A 4/1975 Tolaas
3,899,119 A 8/1975 Roccoforte
3,907,195 A 9/1975 Struble
3,958,744 A 5/1976 Herglotz
4,004,691 A 1/1977 Wihksne
4,008,849 A 2/1977 Baber
4,039,120 A 8/1977 Herzog
4,058,249 A 11/1977 Buck
4,076,168 A 2/1978 Ferri
4,088,262 A 5/1978 Kuehlhorn
4,105,155 A 8/1978 Forbes, Jr.
4,126,261 A 11/1978 Cook
4,185,764 A 1/1980 Cote
4,228,945 A 10/1980 Wysocki
4,250,992 A 2/1981 Gilbert
4,252,264 A 2/1981 Herbst et al.
4,278,197 A 7/1981 Scheinbaum et al.
4,313,542 A 2/1982 Roberts et al.
4,472,896 A 9/1984 Brauner et al.
4,477,014 A 10/1984 Brandenburger
4,492,333 A 1/1985 Roberts
4,530,459 A 7/1985 Maroszek
4,562,916 A 1/1986 Mode
4,572,423 A 2/1986 Spencer
4,592,914 A 6/1986 Kuchenbecker
D287,464 S 12/1986 Mode
4,630,733 A 12/1986 Fear
4,684,023 A 8/1987 Cortopassi
4,705,173 A 11/1987 Forbes, Jr.
4,711,389 A 12/1987 Alba et al.
4,714,190 A 12/1987 Morrocco
4,757,937 A 7/1988 Maio et al.
4,775,771 A 10/1988 Pawlowski et al.
4,798,323 A 1/1989 Platt
4,804,133 A 2/1989 Kiyokane
4,804,137 A 2/1989 Harby
4,815,609 A 3/1989 Kiedaisch
4,865,921 A 9/1989 Hollenberg et al.
4,890,439 A 1/1990 Smart
4,895,259 A 1/1990 Paley
4,901,457 A 2/1990 Chandler
4,915,235 A 4/1990 Roosa
4,919,785 A 4/1990 Willey et al.
4,936,935 A 6/1990 Beckett
4,944,451 A 7/1990 Forbes, Jr.
4,955,528 A 9/1990 Schluckebier
4,963,424 A 10/1990 Beckett
4,993,625 A 2/1991 Stease et al.
5,034,234 A 7/1991 Andreas et al.
5,039,364 A 8/1991 Beckett et al.
5,047,710 A 9/1991 Mahoney
D320,743 S 10/1991 Alexander et al.
5,058,803 A 10/1991 Gulliver
5,071,062 A 12/1991 Bradley et al.
5,078,273 A 1/1992 Kuchenbecker
5,093,364 A 3/1992 Richards
5,096,723 A 3/1992 Turpin
5,117,078 A 5/1992 Beckett
RE33,979 E 6/1992 Cortopassi
5,118,033 A 6/1992 Kula
5,175,404 A 12/1992 Andreas et al.
5,205,474 A 4/1993 Stuart et al.
5,213,902 A 5/1993 Beckett
5,221,419 A 6/1993 Beckett
5,260,537 A 11/1993 Beckett
5,266,386 A 11/1993 Beckett
5,266,763 A 11/1993 Colombo
D342,446 S 12/1993 Parker et al.
5,300,748 A 4/1994 Colombo
D346,552 S 5/1994 Krupa
5,328,089 A 7/1994 Forbes, Jr.
RE34,683 E 8/1994 Maynard et al.
5,338,921 A 8/1994 Maheux et al.
5,340,436 A 8/1994 Beckett
5,354,973 A 10/1994 Beckett
5,358,176 A 10/1994 Rigby
D353,091 S 12/1994 Mumford
5,402,889 A 4/1995 Hermann et al.
5,402,931 A 4/1995 Gulliver et al.
5,410,135 A 4/1995 Pollart et al.
5,424,517 A 6/1995 Habeger, Jr. et al.
5,458,283 A 10/1995 Southwell et al.
5,464,150 A 11/1995 Porres Sanchez et al.
D365,272 S 12/1995 Krupa et al.
5,484,100 A 1/1996 Rigby
5,503,324 A 4/1996 Bacchetti et al.
5,510,132 A 4/1996 Gallo, Jr.
5,519,195 A 5/1996 Keefer et al.
D370,412 S 6/1996 Rohrer
D372,968 S 8/1996 White
D373,081 S 8/1996 Bridger
5,542,536 A 8/1996 Sutherland
5,582,345 A 12/1996 Lankhuijzen
5,585,027 A 12/1996 Young
5,626,283 A 5/1997 Mellon
5,628,921 A 5/1997 Beckett
5,630,544 A 5/1997 Shane
5,657,925 A 8/1997 Norris
5,662,265 A 9/1997 Jensen
5,672,407 A 9/1997 Beckett
5,688,427 A 11/1997 Gallo, Jr.
5,690,273 A 11/1997 Jensen
5,697,549 A 12/1997 Yocum

(56) References Cited

U.S. PATENT DOCUMENTS 5,704,483 A 1/1998 Groh
5,707,004 A 1/1998 Cai
5,720,429 A 2/1998 Cordle
5,726,426 A 3/1998 Davis et al.
5,735,454 A 4/1998 Jensen
5,759,422 A 6/1998 Schmelzer et al.
5,788,081 A 8/1998 Bates
5,800,724 A 9/1998 Habeger et al.
5,826,781 A 10/1998 Jensen
5,871,145 A 2/1999 Hermann et al.
5,875,957 A 3/1999 Yocum
5,890,648 A 4/1999 Cai
5,938,110 A 8/1999 Bernstein
6,027,018 A 2/2000 Yocum
6,041,997 A 3/2000 Jensen
6,050,482 A 4/2000 Cai
6,053,403 A 4/2000 Cai
6,063,415 A 5/2000 Walters
6,068,181 A 5/2000 Cai
6,095,408 A 8/2000 Nguyen
6,102,568 A 8/2000 Davis
6,114,679 A 9/2000 Lai
6,119,930 A 9/2000 Lunstra et al.
6,150,646 A 11/2000 Lai et al.
6,182,890 B1 2/2001 Sattler et al.
6,204,492 B1 3/2001 Zeng et al.
6,216,946 B1 4/2001 Cai
6,251,451 B1 6/2001 Zeng
6,283,364 B1 9/2001 Gray, Sr.
D448,990 S 10/2001 Sorensen et al.
6,349,874 B1 2/2002 Hill
6,386,443 B1 5/2002 Szczerbinski
D458,127 S 6/2002 de Groote
6,401,927 B1 6/2002 Sorensen et al.
D460,691 S 7/2002 Morris et al.
6,414,290 B1 7/2002 Cole et al.
6,419,153 B1 7/2002 Maita
6,433,322 B2 8/2002 Zeng et al.
6,440,050 B1 8/2002 Capparelli
6,455,827 B2 9/2002 Zeng
6,471,119 B2 10/2002 Cai
D467,499 S 12/2002 Garza et al.
D467,797 S 12/2002 Sullivan
6,527,123 B1 3/2003 Ausaf
D473,787 S 4/2003 Jones, Jr. et al.
6,552,315 B2 4/2003 Zeng et al.
6,561,414 B1 5/2003 Cai
6,568,586 B1 5/2003 VanEsley
6,634,547 B2 10/2003 Willis
D484,043 S 12/2003 Hwang et al.
6,677,563 B2 1/2004 Lai
6,681,983 B2 1/2004 Bill-Moore
6,683,289 B2 1/2004 Whitmore et al.
6,695,202 B2 2/2004 Miess
6,705,514 B2 3/2004 Pellati
6,717,121 B2 4/2004 Zeng et al.
6,719,190 B2 4/2004 Yocum
6,744,028 B2 6/2004 Chisholm et al.
6,765,182 B2 7/2004 Cole et al.
6,851,603 B1 2/2005 Carlson et al.
6,866,189 B2 3/2005 Nelson
6,892,932 B2 5/2005 Correll
6,966,483 B2 11/2005 Manninen
6,988,614 B2 1/2006 Hemmingway et al.
7,004,314 B2 2/2006 Pucillo et al.
7,007,837 B2 3/2006 Correll
7,019,271 B2 3/2006 Wnek et al.
D532,690 S 11/2006 Oliveira
7,140,532 B2 11/2006 Holt et al.
7,159,760 B2 1/2007 Pluck et al.
7,182,242 B2 2/2007 Cai
7,232,055 B1 6/2007 Lim
7,273,162 B2 9/2007 Baker
D555,513 S 11/2007 Baker
7,293,695 B2 11/2007 Stier
7,323,699 B2 1/2008 Hopkins et al.
7,364,064 B2 4/2008 Kanamori et al.
7,365,292 B2 4/2008 Cole et al.
7,414,230 B2 8/2008 Fitzwater
7,473,875 B2 1/2009 Fitzwater
7,484,653 B2 2/2009 Hirtado et al.
7,514,659 B2 4/2009 Lafferty
7,562,808 B1 7/2009 Philips
7,565,997 B1 7/2009 Lim
7,617,969 B2 11/2009 Oliveira
7,621,439 B2 11/2009 McClure
7,652,233 B2 1/2010 Keefe
7,667,167 B2 2/2010 Fitzwater
D622,139 S 8/2010 Marcott
D631,743 S 2/2011 Hubbard, Jr.
7,893,389 B2 2/2011 Fitzwater
7,938,257 B2 5/2011 Kohler
7,938,267 B2 5/2011 Cross
7,982,167 B2 7/2011 Fitzwater
8,006,893 B2 8/2011 Burke et al.
8,056,799 B2 11/2011 Burke et al.
8,309,896 B2 11/2012 Fitzwater
8,474,641 B2 7/2013 Hays
8,523,049 B2 9/2013 Fitzwater
D695,608 S 12/2013 Pusta
8,814,033 B2 8/2014 House
9,078,296 B2 7/2015 Fitzwater
9,132,936 B2 9/2015 Kohler
D752,429 S 3/2016 Mayer
9,278,774 B2 3/2016 Fairchild, Jr.
D753,994 S 4/2016 Pantelleria
9,346,234 B2 5/2016 Hajek et al.
9,376,231 B2 6/2016 Pinkstone
D762,468 S 8/2016 Pantelleria
D769,114 S 10/2016 Montemayor
9,499,296 B2 11/2016 Mills et al.
9,540,135 B2 1/2017 Robertson
D842,095 S 3/2019 Hajek
11,059,621 B2 7/2021 Nowak et al.
2002/0108504 A1 8/2002 Cai
2003/0047595 A1 3/2003 Bill-Moore
2003/0080120 A1 5/2003 Whitmore et al.
2003/0106926 A1 6/2003 Beatificato et al.
2003/0206997 A1 11/2003 Winkelman et al.
2004/0074953 A1 4/2004 Yocum
2004/0089656 A1 5/2004 Watkins
2004/0101605 A1 5/2004 Sigel
2004/0159698 A1 8/2004 Tallevi et al.
2005/0045708 A1 3/2005 Bodary et al.
2005/0284865 A1 12/2005 Fogle et al.
2006/0016863 A1 1/2006 Holt et al.
2006/0042989 A1 3/2006 Suter
2006/0049190 A1 3/2006 Middleton
2006/0096978 A1 5/2006 Lafferty et al.
2006/0113300 A1 6/2006 Wnek et al.
2006/0186044 A1 8/2006 Baker
2006/0278521 A1 12/2006 Stowell
2007/0074993 A1 4/2007 Philips
2007/0131742 A1 6/2007 Fitzwater
2007/0131743 A1 6/2007 Fitzwater
2007/0131744 A1 6/2007 Fitzwater
2007/0131745 A1 6/2007 Fitzwater
2007/0138247 A1 6/2007 Fitzwater
2007/0251942 A1 11/2007 Cole et al.
2007/0251943 A1 11/2007 Wnek et al.
2007/0267467 A1 11/2007 Burke et al.
2007/0267468 A1 11/2007 Burke et al.
2007/0275130 A1 11/2007 Cole et al.
2008/0000897 A1 1/2008 Robbins et al.
2008/0047958 A1 2/2008 Cole et al.
2008/0078759 A1 4/2008 Wnek et al.
2008/0081095 A1 4/2008 Cole et al.
2008/0156859 A1 7/2008 Glasgow
2008/0179385 A1 7/2008 Nikolai et al.
2008/0290149 A1 11/2008 Sweet
2008/0308614 A1 12/2008 Fitzwater
2009/0039077 A1 2/2009 Fitzwater
2009/0090708 A1 4/2009 Requena et al.
2009/0200364 A1 8/2009 Oliveira

(56) References Cited

U.S. PATENT DOCUMENTS

| | | | |
|---|---|---|---|
| 2010/0051675 | A1 | 3/2010 | Sweet |
| 2010/0055260 | A1 | 3/2010 | Sweet |
| 2010/0102110 | A1 | 4/2010 | Learn |
| 2010/0243510 | A1 | 9/2010 | Cross |

FOREIGN PATENT DOCUMENTS

| | | |
|---|---|---|
| DE | 296 13 331 | 10/1996 |
| DE | 203 00 817 | 4/2003 |
| EP | 0 270 838 | 6/1988 |
| EP | 1 452 458 | 9/2004 |
| EP | 1 481 922 | 12/2004 |
| EP | 3 871 989 A1 | 9/2021 |
| FR | 2 516 481 | 5/1983 |
| FR | 2 665 882 | 2/1992 |
| FR | 2 687 384 | 8/1993 |
| FR | 2 867 346 | 9/2005 |
| GB | 1049168 | 11/1966 |
| GB | 1189877 | 4/1970 |
| GB | 2 365 000 | 2/2002 |
| JP | 4-253670 | 9/1992 |
| JP | 08-207174 | 8/1996 |
| JP | 10-101056 | 4/1998 |
| JP | 10-203524 A | 8/1998 |
| JP | 03095906 | 6/2003 |
| JP | 2004-059022 | 2/2004 |
| JP | 2004 224402 | 8/2004 |
| JP | 0 3106317 | 10/2004 |
| JP | 2005-170517 | 6/2005 |
| JP | 2007-168832 | 7/2007 |
| JP | 2012-245989 | 12/2012 |
| KR | 20-0253232 | 11/2001 |
| KR | 10-2005-0090313 | 9/2005 |
| WO | WO 91/05448 | 4/1991 |
| WO | WO 94/05563 | 3/1994 |
| WO | WO 96/06021 | 2/1996 |
| WO | WO 02/40374 | 5/2002 |
| WO | WO 03/066435 | 8/2003 |
| WO | WO 2005/077783 | 8/2005 |
| WO | WO 2005/085091 | 9/2005 |
| WO | WO 2006/052326 | 5/2006 |
| WO | WO 2006/076501 | 7/2006 |
| WO | WO 2007/067705 | 7/2007 |
| WO | WO 2007/127235 | 11/2007 |
| WO | WO 2007/133659 | 11/2007 |
| WO | WO 2007/136839 | 11/2007 |
| WO | WO 2008/137525 | 11/2008 |
| WO | WO 2008/137528 | 11/2008 |
| WO | WO 2009/023286 | 11/2009 |

OTHER PUBLICATIONS

Translation of JP10203524 (Date Aug. 1998).*

Hot Dog betaboard Box used for serving hot dog burgers and chips. [online] Published May 29, 2016. Retrieved Aug. 27, 2018 from URL: http://www.packagingbiodegradable.com.au/home/1033-hot-dog-clam-ec-brown--400-pcs.html.

International Search Report and Written Opinion for PCT/US2023/021976 dated Sep. 1, 2023.

* cited by examiner

TRAY WITH DIVIDER FEATURES

CROSS-REFERENCE TO RELATED APPLICATION

This application claims the benefit of U.S. Provisional Patent Application No. 63/341,716, filed on May 13, 2022.

INCORPORATION BY REFERENCE

The disclosures of each of U.S. Provisional Patent Application No. 63/341,716, filed on May 13, 2022, and U.S. Design patent application Ser. No. 29/891,925, filed on May 11, 2023, are hereby incorporated by reference for all purposes as if set forth in their entireties.

BACKGROUND OF THE DISCLOSURE

The present disclosure generally relates to containers for holding at least one article. In one embodiment, the present disclosure relates to containers in the form of trays for holding at least one article and that include divider features.

SUMMARY OF THE DISCLOSURE

According to one aspect, the disclosure is generally directed to a tray for holding one or more articles, the tray comprising a plurality of panels extending at least partially around an interior space of the tray, the plurality of panels comprising a bottom panel, a front panel, a back panel, and at least one side panel, a plurality of end flaps foldably connected to a respective panel of the plurality of panels, and divider features at least partially foldably connected to a respective panel of the plurality of panels, the divider features extend into the interior space of the tray to at least partially form a plurality of compartments in the interior space of the tray.

According to another aspect, the disclosure is generally directed to a blank for forming a tray for holding one or more articles, the blank comprising a plurality of panels for extending at least partially around an interior space of the tray formed from the blank, the plurality of panels comprising a bottom panel, a front panel, a back panel, and at least one side panel, a plurality of end flaps foldably connected to a respective panel of the plurality of panels, and divider features at least partially foldably connected to a respective panel of the plurality of panels, the divider features for extending into the interior space of the tray formed from the blank to at least partially form a plurality of compartments in the interior space of the tray formed from the blank.

According to another aspect, the disclosure is generally directed to a method of forming a tray for holding one or more articles, the method comprising obtaining a blank comprising a plurality of panels comprising a bottom panel, a front panel, a back panel, and at least one side panel, the blank further comprising a plurality of end flaps foldably connected to a respective panel of the plurality of panels, and divider features foldably connected to a respective panel of the plurality of panels, positioning the plurality of panels extending at least partially around an interior space of the tray, and positioning the divider features extending into the interior space of the tray to at least partially form a plurality of compartments in the interior space of the tray.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Trays according to the present disclosure can accommodate articles of numerous different shapes. In this specification, the terms "lower," "bottom," "upper," "top," "front," and "back" indicate orientations determined in relation to fully erected trays. As described herein, containers may be formed by multiple overlapping panels, portions, and/or end flaps. Such panels, portions, and/or end flaps may be designated in relative terms to one another, e.g., "first", "second", "third", etc., in sequential or non-sequential reference, without departing from the disclosure.

Figure 1:
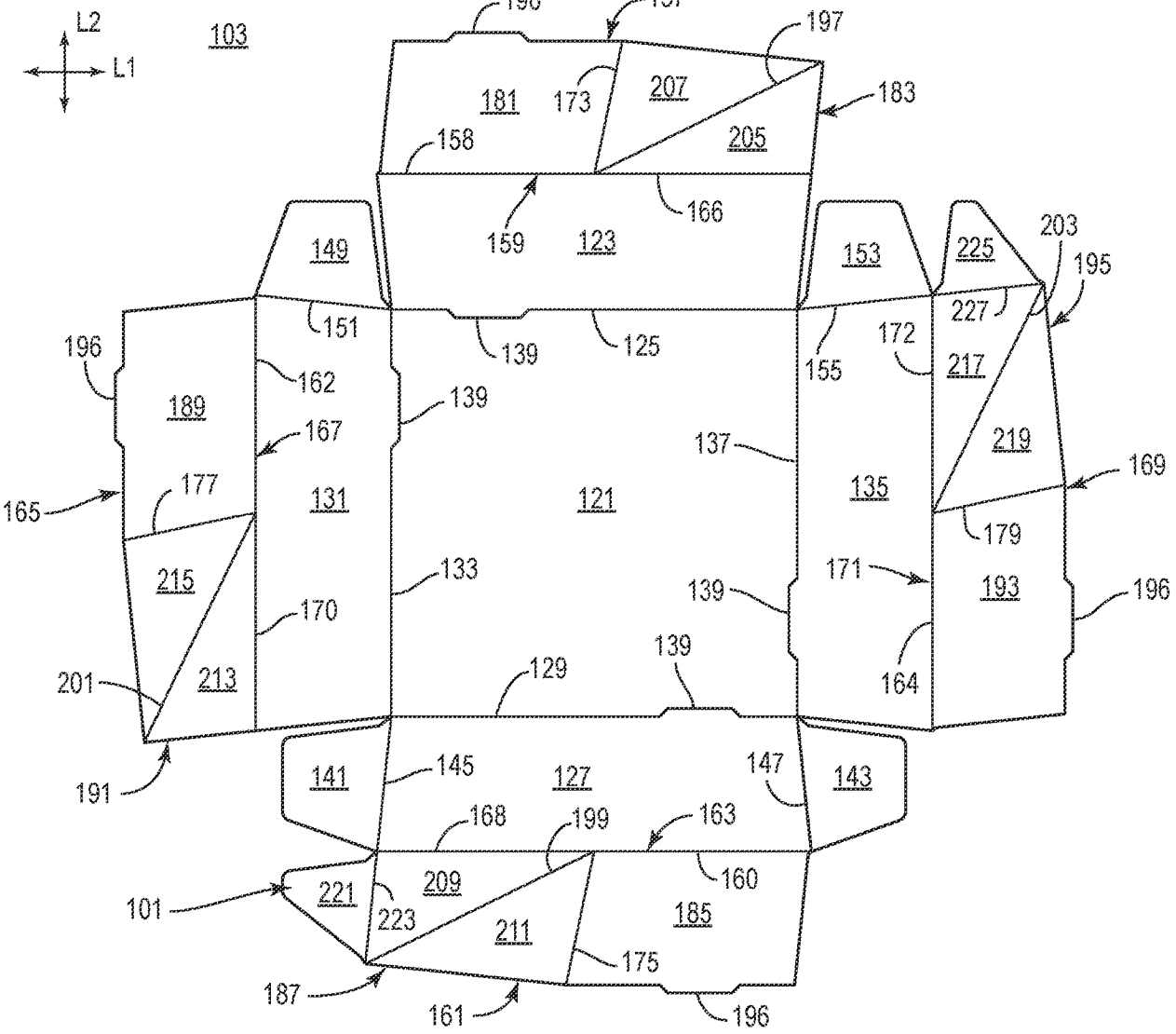
FIG. 1 is a plan view of an exterior surface of a blank for forming a tray according to an exemplary embodiment of the disclosure.
Figure 4:
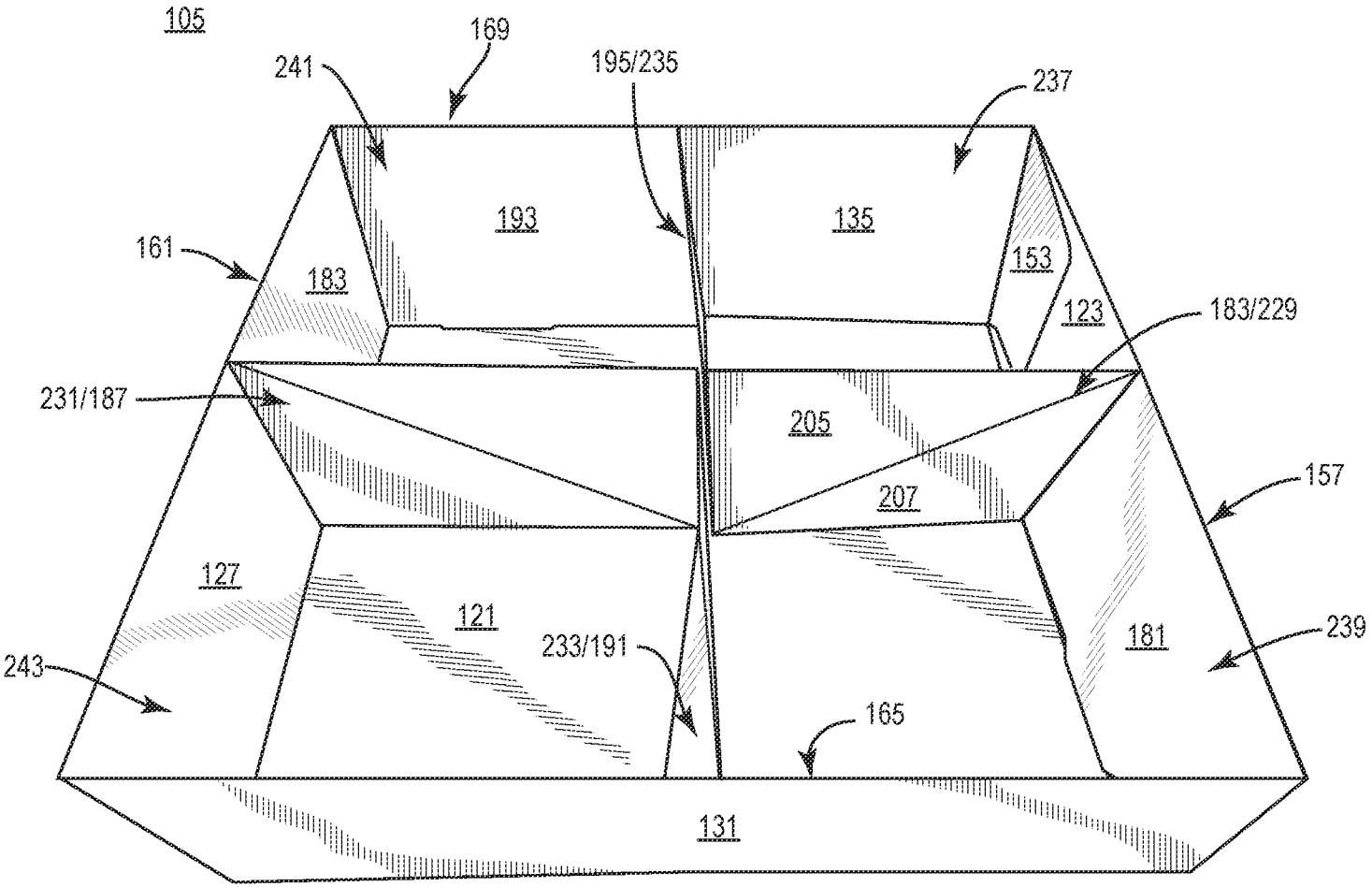
FIG. 4 is a perspective view of a tray formed from the blank of FIG. 1 according to the exemplary embodiment of the disclosure.

According to an exemplary embodiment of the disclosure, FIG. 1 illustrates an exterior surface 101 of a blank 103 for forming a container in the form of a tray 105 (FIG. 4). It will be understood that the tray 105 can have a different configuration, for example, a bowl, dish, plate, box, or carton, to name a few.

The tray 105 can be used for holding one or more articles such as food products, e.g., portioned retail food products that can include one or more of cookies, crackers, cakes, pastries, candies, nuts, popcorn, trail mix, gum, etc. In some embodiments, the articles can include frozen or non-frozen food products that can be provided in discrete portions, for example, chicken nuggets, French fries, onion rings, mozzarella sticks, chips, popcorn, other finger foods, etc. In embodiments, other types of articles that can include food products and/or non-food products can be placed in the tray 105 for service to a customer, for example, at a quick service restaurant or vendor. In some embodiments, such products can be contained in additional packaging and then placed in the tray 105. The tray 105 could be otherwise shaped and arranged and could be used to hold other products and/or articles in similar or different environments without departing from the disclosure. In some embodiments, the tray 105 can be configured to hold one or more articles provided in a separate packaging.

As shown in FIG. 1, the blank 103 has a lateral axis L1 and a longitudinal axis L2. In the illustrated embodiment, and as described further herein, the blank 103 includes a plurality of panels for extending at least partially around an interior space 107 of the tray 105 formed from the blank 103, a plurality of end flaps foldably connected to a respective panel of the plurality of panels, and divider features for forming one or more divider features of the tray 105 formed from the blank 103. Such divider features can be arranged and configured to extend into an interior of the tray 105 formed from the blank 103 to at least partially form a plurality of compartments in the interior of the tray 105 formed from the blank 103.

The plurality of panels of the blank 103 can include a bottom panel 121, a front panel 123 foldably connected to the bottom panel 121 at a longitudinal fold line 125 (broadly, "third side panel"), a back panel 127 (broadly, "fourth side panel") foldably connected to the bottom panel 121 at a longitudinal fold line 129, a first side panel 131 foldably connected to the bottom panel 121 at a lateral fold line 133, and a second side panel 135 foldably connected to the bottom panel 121 at a lateral fold line 137.

Each fold line 125, 129, 133, 137, as shown, can be interrupted by a respective locking cut 139 having one or more of straight, curved, and/or angled portions for receiving one or more other portions of the blank 103/tray 105, as described further herein.

As described above, the blank 103 and tray 105 formed therefrom include a plurality of end flaps foldably connected to a respective panel of the plurality of panels. The plurality of end flaps can include a pair of attachment end flaps 141, 143 foldably connected to the back panel 127 at a respective pair of oblique fold lines 145, 147, an attachment end flap 149 foldably connected to the first side panel 131 at an oblique fold line 151, and an attachment end flap 153 foldably connected to the second side panel 135 at an oblique fold line 155.

The plurality of end flaps can also include a front divider end flap 157 (broadly, "first divider end flap") foldably/separably connected to the front panel 123 at a longitudinal fold line or line of weakening 159, a back divider end flap 161 (broadly, "second divider end flap") foldably/separably connected to the back panel 127 at a longitudinal line of weakening 163, a first side divider end flap 165 (broadly, "third divider end flap") foldably/separably connected to the side panel 131 at a lateral line of weakening 167, and a second side divider end flap 169 (broadly, "fourth divider end flap") foldably/separably connected to the side panel 135 at a lateral line of weakening 171.

Each line of weakening 159, 163, 167, 171 can include a respective foldable portion 158, 160, 162, 164 at which the respective portion of the respective divider end flap 157, 161, 165, 169 is generally foldably connected to the respective panel 123, 127, 131, 135, and a respective separable portion 166, 168, 170, 172 at which the respective portion of the respective divider end flap 157, 161, 165, 169 is generally separably connected to the respective panel 123, 127, 131, 135.

Furthermore, each divider end flap 157, 161, 165, 169 can be at least partially bisected by a respective oblique fold line 173, 175, 177, 179 to define a respective first portion and second portion thereof. In this regard, the divider end flap 157 can include a first portion 181 foldably connected to the front panel 123 at the foldable portion 158 of the line of weakening 159 and a second portion 183 separably connected to the front panel 123 at the separable portion 166 of the line of weakening 159, the divider end flap 161 can include a first portion 185 foldably connected to the back panel 127 at the foldable portion 160 of the line of weakening 163 and a second portion 187 separably connected to the back panel 127 at the separable portion 168 of the line of weakening 163, the divider end flap 165 can include a first portion 189 foldably connected to the first side panel 131 at the foldable portion 162 of the line of weakening 167 and a second portion 191 foldably connected to the second side panel 131 at the separable portion 170 of the line of weakening 167, and the divider end flap 169 can include a first portion 193 foldably connected to the second side panel 135 at the foldable portion 164 of the line of weakening 171 and a second portion 195 separably connected to the second side panel 135 at the separable portion 172 of the line of weakening 171.

The respective first portions 181, 185, 189, 193 of the respective divider end flaps 157, 161, 165, 169 can include respective locking tabs 196 protruding therefrom for at least partial receipt in the respective locking cuts 139 in the respective fold lines 125, 129, 133, 137, e.g., so as to be positioned at least partially along the bottom panel 121, to facilitate formation/maintenance of an erected configuration of the tray 105. In this regard, the locking cuts 139 and locking tabs 196 can be locking features of the blank 103 for forming locking features of the tray 105.

As also shown, each respective second portion 183, 187, 191, 195 of the respective divider end flaps 157, 161, 165, 169 can be at least partially bisected by a respective oblique fold line 197, 199, 201, 203 to define a respective base portion and a respective distal portion. In this regard, the second portion 183 of the divider end flap 157 can include a base portion 205 separably connected to the front panel 123 at the separable portion 166 of the line of weakening 159 and a distal portion 207 foldably connected to the base portion 205 at the oblique fold line 197, the second portion 187 of the divider end flap 161 can include a base portion 209 separably connected to the back panel 127 at the separable portion 168 of the line of weakening 163 and a distal portion 211 foldably connected to the base portion 209 at the oblique fold line 199, the second portion 191 of the divider end flap 165 can include a base portion 213 separably connected to the first side panel 131 at the separable portion 170 of the line of weakening 167 and a distal portion 215 foldably connected to the base portion 213 at the oblique fold line 201, and the second portion 195 of the divider end flap 169 can include a base portion 217 separably connected to the second side panel 135 at the separable portion 172 of the line of weakening 171 and a distal portion 219 foldably connected to the base portion 217 at the oblique fold line 203.

With continued reference to FIG. 1, the plurality of end flaps can further include an attachment end flap 221 foldably connected to the second portion 187 of the divider end flap 161 at an oblique fold line 223 and an attachment end flap 225 foldably connected to the second portion 195 of the divider end flap 169 at an oblique fold line 227.

It will be understood that one or more of the flaps, panels, lines of weakening, and/or associated features of the blank 103 can have a different configuration and/or arrangement without departing from the disclosure.

With additional reference to FIGS. 2-4, formation of the tray 105 from the blank 103 according to an exemplary embodiment of the disclosure will be described. As shown, the blank 103 can be inverted, e.g., such that the exterior surface 101 is positioned on a supporting surface and such that an interior surface of the blank 103 is positioned facing upwardly.

The panels 123, 127, 131, 135 can be raised upwardly at the respective fold lines 125, 129, 133, 137 such that the panels 123, 127, 131, 135 are positioned extending generally upwardly from the bottom panel 121. Furthermore, the divider end flaps 157, 161, 165, 169 can be carried upwardly with the movement of the respective panels 123, 127, 131, 135.

The aforementioned arrangement of the tray 105 can be a first configuration of the tray 105, e.g., for shipping, transport, storage, stacking etc. In this regard, the panels 123, 127, 131, 135 extend upwardly and outwardly from the bottom panel 121 such that the panels 123, 127, 131, 135 and divider end flaps 157, 161, 165, 169 have a generally tapered arrangement toward the bottom panel 121. In such an arrangement, an opening defined by the upper edges of divider end flaps 157, 161, 165, 169 can define an area larger than an area defined by the bottom panel 121. In this regard, the interior space 107 of the tray 105 can be configured to at least partially receive another tray 105 therein, e.g., in a nested or stacking arrangement.

In order to reconfigure the tray 105 from the first configuration to a second configuration, e.g., for serving, packing, etc., the attachment end flaps 141, 143 can be folded at the respective fold lines 145, 147 into at least partial face-to-face contact with the interior surfaces of the respective panels 131, 135, the attachment end flap 149 can be folded at the fold line 151 into at least partial face-to-face contact with the interior surface of the panel 123, the attachment end flap 153 can be folded at the fold line 155 into at least partial face-to-face contact with the interior surface of the panel 123, the attachment end flap 221 can be folded at the fold line 223 and positioned in at least partial face-to-face contact with the interior surface of the base portion 213 of the second portion 191 of the divider end flap 165, and the attachment end flap 225 can be folded at the fold line 227 and positioned into at least partial face-to-face contact with the interior surface of the base portion 205 of the second portion 183 of the divider end flap 157.

Such arrangement of the panels and flaps of the tray 105 can be at least partially maintained with one or more applications of an adhesive such as glue. In one embodiment, glue can be applied to an exterior surface of one or more of the attachment end flaps 141, 143, 149, 153, 221, 225.

Figure 2:
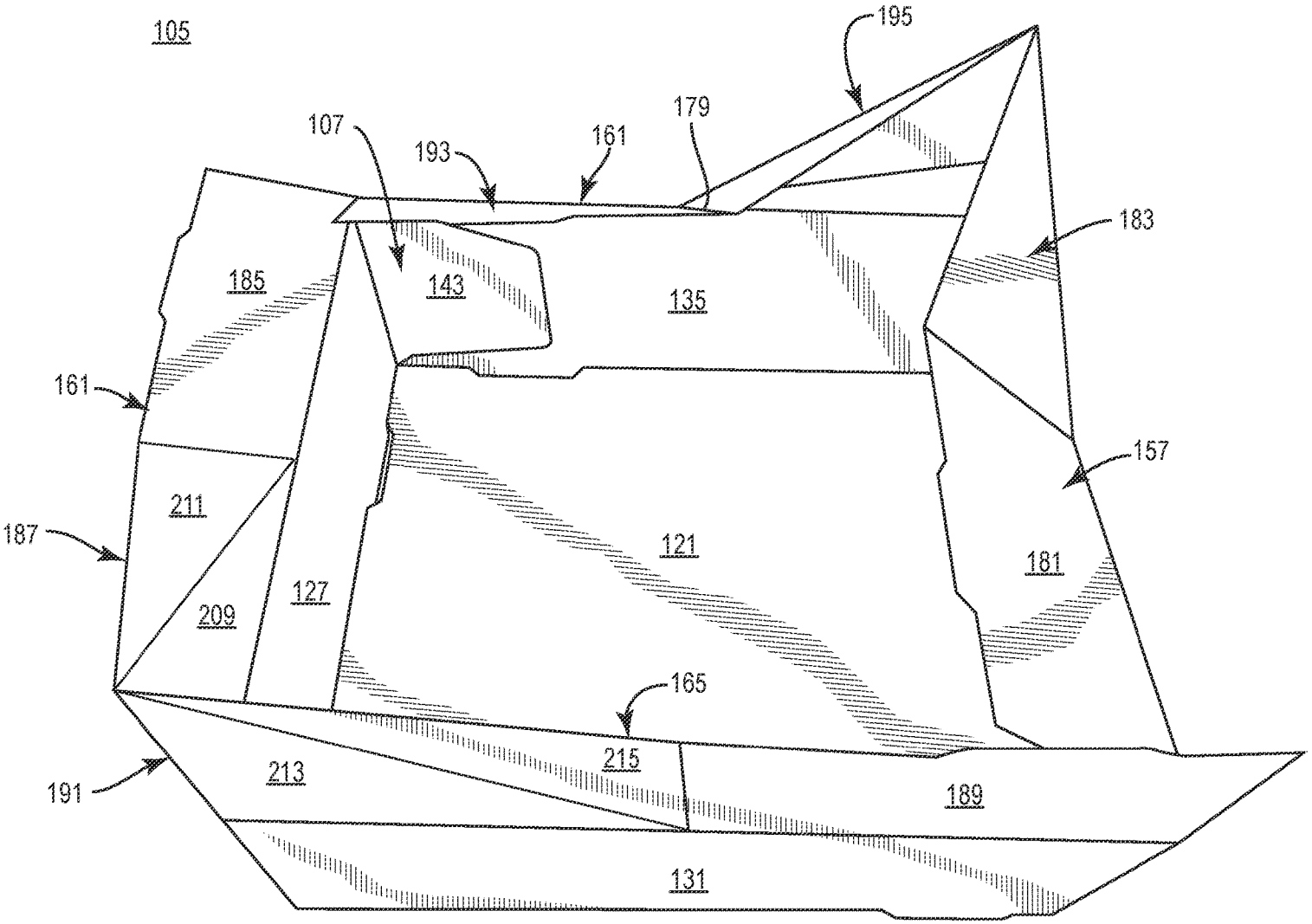
FIG. 2 is a first sequential perspective view of a formation of a tray from the blank of FIG. 1 according to the exemplary embodiment of the disclosure.
Figure 3:
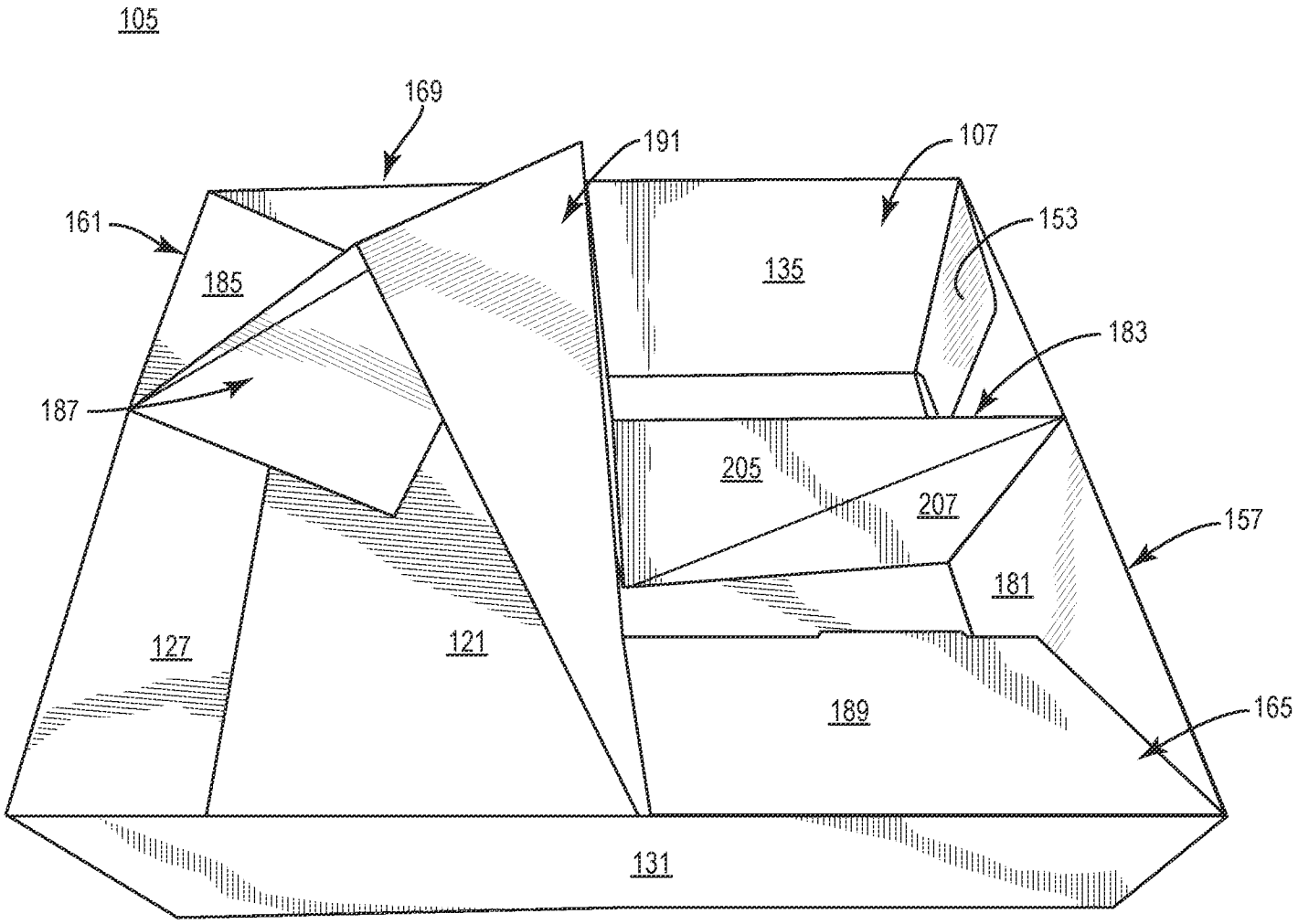
FIG. 3 is a second sequential perspective view of a formation of a tray from the blank of FIG. 1 according to the exemplary embodiment of the disclosure.

As shown in FIGS. 2-4, the aforementioned arrangement of the divider end flaps 157, 161, 165, 169, in which the divider end flaps 161, 165 are at least partially attached via the attachment end flap 221 and in which the divider end flaps 157, 169 are at least partially attached via the attachment end flap 225, can be reconfigured to form the divider features of the tray 105.

The first portions 181, 189 of the respective divider end flaps 157, 165 can be folded downward at the respective foldable portions 158, 162 of the respective lines of weakening 159, 167 into at least partial face-to-face contact with respective portions of the panels 123, 131. Such movement of the first portions 181, 189 of the respective divider end flaps 157, 165 can cause the respective second portions 183, 191 thereof to separate from the respective panels 123, 131 at the respective separable portions 166, 170 of the respective lines of weakening 159, 167.

Continued movement of the divider end flaps 157, 165 can include relative movement of the first portion 181 and the second portion 183 of the divider end flap 157 at the fold line 173, relative movement of the base portion 205 and the distal portion 207 of the second portion 183 of the divider end flap 157 at the fold line 197, relative movement of the first portion 189 and the second portion 191 of the divider end flap 165 at the fold line 177, and relative movement of the base portion 213 and the distal portion 215 of the second portion 191 of the divider end flap 165 at the fold line 201.

Similarly, the first portions 185, 193 of the respective divider end flaps 161, 169 can be folded downwardly at the respective foldable portions 160, 164 of the respective lines of weakening 163, 171 into at least partial face-to-face contact with respective portions of the panels 127, 135. Such movement of the first portions 185, 193 of the respective divider end flaps 161, 169 can cause the respective second portions 187, 195 thereof to separate from the respective panels 127, 135 at the respective separable portions 168, 172 of the respective lines of weakening 163, 171. Continued movement of the divider end flaps 161, 169 can include relative movement of the first portion 185 and the second portion 187 of the divider end flap 161 at the fold line 175, relative movement of the base portion 209 and the distal portion 211 of the second portion 187 of the divider end flap 161 at the fold line 199, relative movement of the first portion 193 and the second portion 195 of the divider end flap 169 at the fold line 179, and relative movement of the base portion 217 and the distal portion 219 of the second portion 195 of the divider end flap 169 at the fold line 203.

The second configuration of the tray 105 is illustrated in FIG. 4, in which the second portion 183 of the divider end flap 157 extends generally perpendicularly from the panel 123 and the first portion 181 of the divider end flap 157 into the interior space 107 of the tray 105 to form a first divider wall 229, the second portion 187 of the divider end flap 161 extends generally perpendicularly from the panel 127 and the first portion 185 of the divider end flap 161 into the interior space 107 of the tray 105 to form a second divider wall 231, the second portion 191 of the divider end flap 165 extends generally perpendicularly from the panel 131 and the first portion 189 of the divider end flap 165 into the interior space 107 of the tray 105 to form a third divider wall 233, and the second portion 195 of the divider end flap 169 extends generally perpendicularly from the panel 135 and the first portion 193 of the divider end flap 169 into the interior space 107 of the tray 105 to form a fourth divider wall 235, with the first divider wall 229 intersecting and/or generally collinear with the second divider wall 231, the third divider wall 233 intersecting and/or generally collinear with the fourth divider wall 235, and with each of the first divider wall 229 and the second divider wall 231 generally perpendicular to each of the third divider wall 233 and the fourth divider wall 235.

The aforementioned arrangement of the divider features of the tray 105 can be such that the first divider wall 229 is positioned between a first compartment 237 and a second compartment 239 of the interior 207 of the tray 105, the second divider wall 231 is positioned between a third compartment 241 and a fourth compartment 243, the third divider wall 233 is positioned between the compartments 239, 243, and the fourth divider wall 235 is positioned between the compartments 237, 241.

In this regard, the divider features of the blank 103 and the tray 105 formed therefrom include respective portions of one or more of the divider end flaps 157, 161, 165, 169. Accordingly, the divider features of the blank 103 are at least partially foldably connected to respective panels of the plurality of panels, and adjacent divider features are attached to one another. Such arrangement of the divider features of the blank 103 and tray 105 formed therefrom facilitates reconfiguration of the tray 105 between the first configuration, in which the tray 105 is positioned and arranged for nesting/stacking with one or more other trays or containers, and the second configuration of the tray 105, in which the divider features extend at least partially into the interior space 107 of the tray 105 to define the plurality of compartments 237, 229, 241, 243.

It will be understood that blanks and trays according to the present disclosure can have a different number, arrangement, and/or configuration of features without departing from the disclosure.

In some embodiments, upper portions of the tray 105, for example, proximate the lines of weakening 159, 163, 167, 171 when the tray 105 is in the second configuration, can be configured for engaging/supporting a covering or lidding film, e.g., a plastic or other polymeric film, or other covering structure. In one embodiment, the lidding film can be provided as a polymeric layer that at least partially deforms in the presence of a heat source, e.g., a heat sealable film. The lidding film can thus be positioned extending across a top opening of the tray 105 to cover the interior space 107 of the tray 105 and maintain one or more conditions of the food products held therein, e.g., freshness, ripeness, moisture content, etc. It will be understood that the lidding film can minimize, inhibit, and/or prevent the passage of one or more materials into the interior space 107 of the tray 105, for example, condensation or other moisture, insects or other pests, dirt, debris, etc. In one embodiment, the tray 105 can be provided together with the lidding film and one or more food products as a package.

Figure 5:
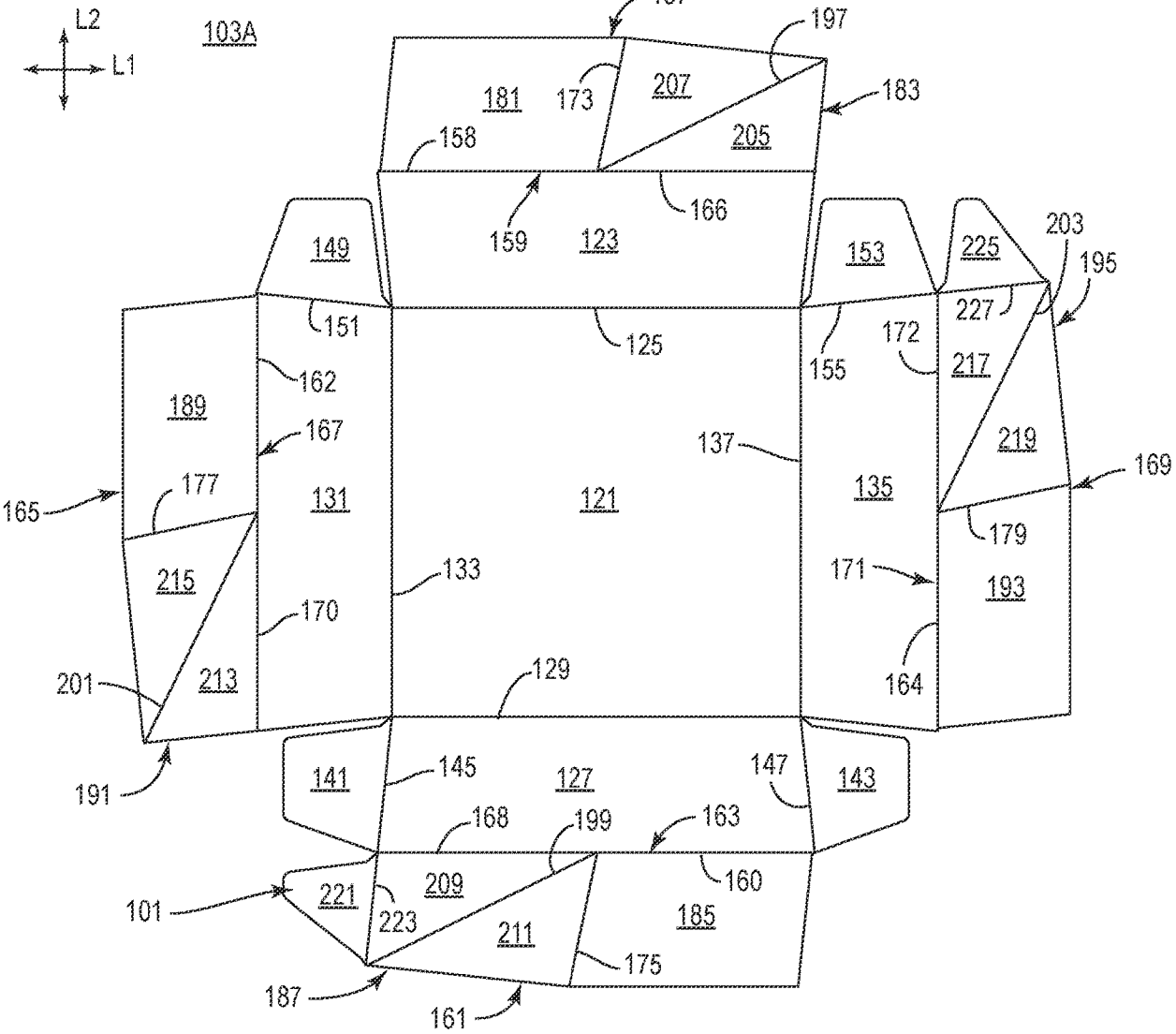
FIG. 5 is a plan view of an exterior surface of a blank according to an alternative configuration of the exemplary embodiment of the disclosure.

Referring to FIG. 5, an exterior surface of an alternative configuration of the blank 103 is generally designated 103A. As shown, the blank 103A can have a configuration generally similar to that described above with regard to the blank 103, but can be devoid of one or more of the cuts 139 and tabs 196 so as to have a different configuration of locking features as comparted to the blank 103 described above.

Figure 6:
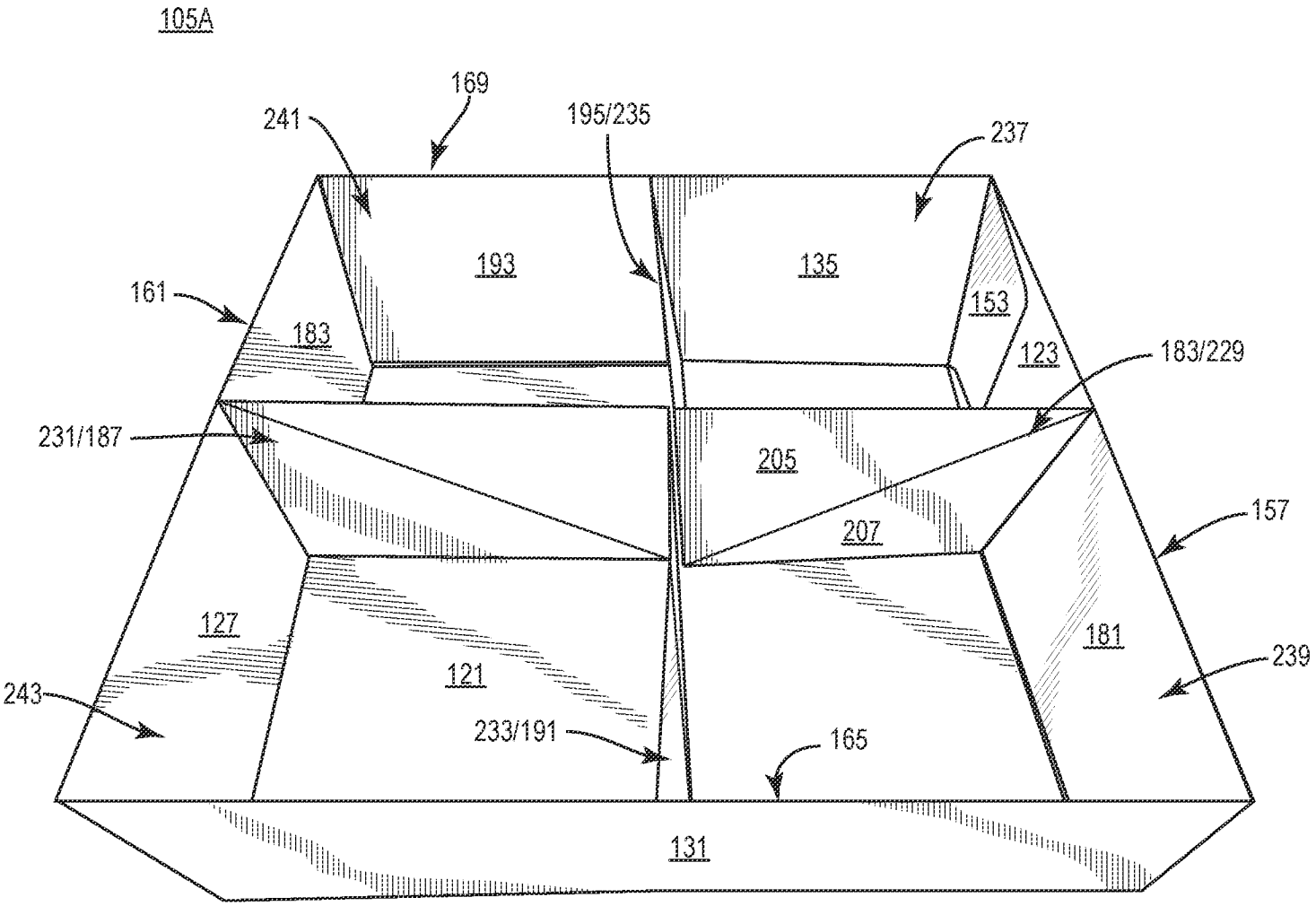
FIG. 6 is a perspective view of a tray formed from the blank of FIG. 5 according to the alternative configuration of the exemplary embodiment of the disclosure.

As shown in FIG. 6, the blank 103A can be formed into a tray 105A in a manner similar to that described above with regard to the formation of the tray 105 from the blank 103, without inserting the tabs 196 through the respective cuts 139. In this regard, the tray 105A may provide a streamlined or construction with similar advantages to those described above with regard to the tray 105.

In general, the blanks described herein may be constructed from paperboard having a caliper so that it is heavier and more rigid than ordinary paper. The blanks can also be constructed of other materials, such as cardboard, sheet plastics or any other material having properties suitable for enabling the container to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the container embodiments. The term "glue" is intended to encompass all manner of adhesives commonly used to secure container panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding one or more articles, the tray comprising:

a bottom panel, a front panel, a back panel, a first side panel, and a second side panel defining an interior space of the tray;

a first end flap having a first attached portion foldably connected to a first detached portion, the first attached portion foldably connected to the front panel, wherein the first detached portion includes a first base portion connected to a first distal portion along an oblique fold line, the first distal portion foldably connected to the first attached portion; and a second end flap having a second attached portion foldably connected to a second detached portion, the second attached portion foldably connected to the first side panel, wherein the second detached portion includes a second base portion foldably connected to a second distal portion, the second distal portion foldably connected to the second attached portion, wherein the first base portion is attached to the second base portion such that the first and second detached portions cooperatively define a compartment within the interior of the tray.

2. The tray of claim 1, wherein the first attached portion of the first end flap is positioned in at least partial face-to-face contact with the front panel, and the second attached portion of the second end flap is positioned in at least partial face-to-face contact with the first side panel.

3. The tray of claim 1, further comprising a third end flap having a third attached portion foldably connected to a third detached portion, the third attached portion foldably connected to the back panel, wherein the third detached portion includes a third base portion foldably connected to a third distal portion, the third distal portion foldably connected to the third attached portion.

4. The tray of claim 3, the tray further comprising a fourth end flap having a fourth attached portion foldably connected to a fourth detached portion, the fourth attached portion foldably connected to the second side panel, wherein the fourth detached portion includes a fourth base portion foldably connected to a fourth distal portion, the fourth distal portion foldably connected to the fourth attached portion, wherein the third base portion is attached to the fourth base portion such that the third and fourth detached portions cooperatively define an additional compartment within the interior of the tray.

5. The tray of claim 4, wherein the first detached portion is generally positioned perpendicular to the second detached portion after cooperatively defining the compartment and wherein the third detached portion is generally positioned perpendicular to the fourth detached portion after cooperatively defining the additional compartment.

6. The tray of claim 5, wherein the first detached portion is generally perpendicular to the fourth detached portion after the compartment and the additional compartment are defined.

7. The tray of claim 4, wherein the third attached portion of the third end flap is positioned in at least partial face-to-face contact with the back panel, and the fourth attached portion of the fourth end flap is positioned in at least partial face-to-face contact with the second side panel.

8. The tray of claim 4, further comprising locking features, the locking features comprising a locking tab extending from at least one of the first end flap, the second end flap, the third end flap, and the fourth end flap, the locking tab at least partially received in a locking cut formed along the bottom panel for maintaining an erected configuration of the tray.

9. A blank for forming a tray for holding one or more articles, the blank comprising:

a bottom panel, a front panel, a back panel, a first side panel, and a second side panel for defining an interior space of the tray formed from the blank;

a first end flap having a first attached portion foldably connected to a first detached portion, the first attached portion foldably connected to the front panel, wherein the first detached portion includes a first base portion connected to a first distal portion along an oblique fold line, the first distal portion foldably connected to the first attached portion; and a second end flap having a second attached portion foldably connected to a second detached portion, the second attached portion foldably connected to the first side panel, wherein the second detached portion includes a second base portion foldably connected to a second distal portion, the second distal portion foldably connected to the second attached portion, wherein the first base portion is attachable to the second base portion such that the first and second detached portions cooperatively define a compartment within the interior of the tray when forming the tray.

10. The blank of claim 9, wherein the first attached portion of the first end flap forms an at least partial face-to-face contact with the front panel when the tray is formed from the blank, and the second attached portion of the second end flap forms an at least partial face-to-face contact with the first side panel when the tray is formed from the blank.

11. The blank of claim 9, further comprising a third end flap having a third attached portion foldably connected to a third detached portion, the third attached portion foldably connected to the back panel, wherein the third detached portion includes a third base portion foldably connected to a third distal portion, the third distal portion foldably connected to the third attached portion.

12. The blank of claim 11, further comprising a fourth end flap having a fourth attached portion foldably connected to a fourth detached portion, the fourth attached portion foldably connected to the second side panel, wherein the fourth detached portion includes a fourth base portion foldably connected to a fourth distal portion, the fourth distal portion foldably connected to the fourth attached portion, wherein the third base portion is attached to the fourth base portion such that the third and fourth detached portions cooperatively define an additional compartment within the interior of the tray when the tray is formed from the blank.

13. The blank of claim 12, wherein the first detached portion is generally positioned perpendicular to the second detached portion after cooperatively defining the compartment and wherein the third detached portion is generally positioned perpendicular to the fourth detached portion after cooperatively defining the additional compartment when forming the tray from the blank.

14. The blank of claim 12, further comprising locking features, the locking features comprising a locking tab extending from at least one of the first end flap, the second end flap, the third-end flap, and the fourth end flap, the locking tab for being received in a locking cut formed along the bottom panel for maintaining an erected configuration of the tray formed from the blank.

15. A method of forming a tray for holding one or more articles, the method comprising:

obtaining a blank comprising a plurality of panels comprising a bottom panel, a front panel, a back panel, a first side panel, and a second side panel, the blank further comprising a first end flap having a first attached portion foldably connected to a first detached portion, the first attached portion foldably connected to the front panel, wherein the first detached portion includes a first base portion connected to a first distal portion along an oblique fold line, the first distal portion foldably connected to the first attached portion and the blank further comprising a second end flap having a second attached portion foldably connected to a second detached portion, the second attached portion foldably connected to the first side panel, wherein the second detached portion includes a second base portion foldably connected to a second distal portion, the second distal portion foldably connected to the second attached portion;

positioning the plurality of panels extending at least partially around an interior space of the tray;

attaching the first base portion to the second base portion; and folding the first and second detached portions into the interior of the tray such that the first and second detached portions cooperatively define a compartment within the interior of the tray.

16. The method of claim 15, further comprising forming an at least partial face-to-face contact between the first attached portion of the first end flap and the front panel, and forming an at least partial face-to-face contact between the second attached portion of the second end flap and the first side panel.

17. The method of claim 15, the blank further comprising a third end flap having a third attached portion foldably connected to a third detached portion, the third attached portion foldably connected to the back panel, wherein the third detached portion includes a third base portion foldably connected to a third distal portion, the third distal portion foldably connected to the third attached portion.

18. The method of claim 17, the blank further comprising a fourth end flap having a fourth attached portion foldably connected to a fourth detached portion, the fourth attached portion foldably connected to the second side panel, wherein the fourth detached portion includes a fourth base portion foldably connected to a fourth distal portion, the fourth distal portion foldably connected to the fourth attached portion, the method further comprising attaching the third base portion to the fourth base portion and folding the third and fourth detached portions into the interior of the tray such that the third and fourth detached portions cooperatively define an additional compartment within the interior of the tray when the blank is formed from the tray.

19. The method of claim 18, wherein folding the first and second detached portions comprises folding the first and second detached portions such that the first detached portion is generally positioned perpendicular to the second detached portion after cooperatively defining the compartment and wherein folding the third and fourth detached portions comprises folding the third and fourth portions such that the third detached portion is generally positioned perpendicular to the fourth detached portion after cooperatively defining the additional compartment.

20. The method of claim 18, the blank further comprising locking features, the locking features comprising a locking tab extending from at least one of the first end flap, the second end flap, the third end flap, and the fourth end flap, and the method further comprises positioning the locking tab at least partially received in a locking cut formed along the bottom panel for maintaining an erected configuration of the tray.

* * * * *